US008794226B2

(12) United States Patent
Schmidbauer et al.

(10) Patent No.: US 8,794,226 B2
(45) Date of Patent: Aug. 5, 2014

(54) OVEN MUFFLE

(75) Inventors: Wolfgang Schmidbauer, Mainz (DE); Sascha Backes, Rüdesheim (DE); Helga Götz, Heidesheim (DE); Thomas Zenker, Nieder-Olm (DE); Martin Taplan, Rheinböllen (DE)

(73) Assignee: Schott AG, Mainz (DE)

( * ) Notice: Subject to any disclaimer, the term of this patent is extended or adjusted under 35 U.S.C. 154(b) by 937 days.

(21) Appl. No.: 12/455,305

(22) Filed: May 29, 2009

(65) Prior Publication Data

US 2009/0301460 A1 Dec. 10, 2009

(30) Foreign Application Priority Data

May 29, 2008 (DE) ..... 10 2008 025 907

(51) Int. Cl.
*F24C 15/00* (2006.01)

(52) U.S. Cl.
USPC ..... 126/19 R; 425/84; 126/681; 126/1 R; 126/25 R; 126/9 R; 126/37 R; 126/39 B; 126/39 C; 126/273 R; 126/222; 126/225

(58) Field of Classification Search
USPC ..... 126/19 R, 681; 425/84
IPC ..... F24C 15/00,15/16
See application file for complete search history.

(56) References Cited

U.S. PATENT DOCUMENTS

| | | | | |
|---|---|---|---|---|
| 3,143,638 | A * | 8/1964 | Scott | 219/395 |
| 3,410,987 | A * | 11/1968 | Hurko et al. | 219/397 |
| 3,452,183 | A * | 6/1969 | Burger | 219/406 |
| 4,262,183 | A * | 4/1981 | Smith et al. | 219/681 |
| 4,880,955 | A * | 11/1989 | Nitzinger et al. | 219/758 |
| 5,670,181 | A * | 9/1997 | Stokes | 425/84 |
| 5,767,492 | A * | 6/1998 | Pinceloup | 219/699 |
| 6,589,049 | B1 * | 7/2003 | Sutton et al. | 432/115 |
| 6,892,723 | B2 * | 5/2005 | Anschutz et al. | 126/273 R |
| 7,232,979 | B2 * | 6/2007 | Bray | 219/756 |
| 2004/0149722 | A1 * | 8/2004 | Schnell et al. | 219/460.1 |
| 2005/0199616 | A1 * | 9/2005 | Stahli | 219/680 |

FOREIGN PATENT DOCUMENTS

| | | |
|---|---|---|
| CA | 2183498 | 2/1987 |
| DE | 33 02 794 A1 | 8/1984 |
| DE | 35 27 957 C2 | 2/1987 |
| DE | 35 27 958 C2 | 2/1987 |
| DE | 102 03 607 A1 | 7/2003 |

(Continued)

OTHER PUBLICATIONS

Co-Pending U.S. Appl. No. 12/455,306, filed May 29, 2009; inventors Martin Taplan et al.; title Oven Muffle.

*Primary Examiner* — Kang Hu
*Assistant Examiner* — Nathaniel Herzfeld
(74) *Attorney, Agent, or Firm* — Pauley Petersen & Erickson

(57) ABSTRACT

An oven muffle that has at least two wall elements adjoining each other, which delimit at least some regions of an interior space that is used as a cooking chamber. The wall elements are of a glass or a glass ceramic and the adjacent wall elements are oriented at an angle with respect to one another. In an oven muffle of this invention, along with ease of cleaning, a simple structural design is achieved if the wall elements are integrally joined to one another and constitute one formed part.

34 Claims, 11 Drawing Sheets

(56) References Cited

FOREIGN PATENT DOCUMENTS

| | | | |
|---|---|---|---|
| DE | 102 03 609 | A1 | 7/2003 |
| DE | 102 03 610 | A1 | 7/2003 |
| DE | 102007051255 | A1 * | 5/2008 |
| EP | 0 416 030 | B1 | 3/1991 |
| EP | 1655544 | A2 * | 5/2006 |
| WO | WO 00/40912 | | 7/2000 |

* cited by examiner

OVEN MUFFLE

PRIORITY CLAIM

German Patent Reference 10 2008 025 907.1, filed 29 May 2008, the priority document corresponding to this invention, to which a foreign priority benefit is claimed under Title 35, United States Code, Section 119, and its entire teachings are incorporated, by reference, into this specification.

BACKGROUND OF THE INVENTION

1. Field of the Invention

This invention relates to an oven muffle, in particular an oven muffle having at least two wall elements adjoining each other which delimit at least some regions of an interior space that can be used as a cooking chamber, in which the wall elements are composed of glass or glass ceramic and the adjacent wall elements are oriented at an angle to one another.

2. Discussion of Related Art

Electrically heated ovens for freestanding ranges or for installation in a kitchen unit are generally known. The oven is essentially composed of an enameled oven muffle, which is heated from above and below with tubular heating elements. On the front side, the oven muffle is closed by a framed glass door. Usually, the upper heating system is situated on the interior of the oven muffle and in high-end ovens, is also assisted by a second heating element that enables the oven to execute a grilling function. The lower heating element is attached to the outside of the muffle floor. In addition to these standard heating schemes for upper/lower heating and grilling mode, a recirculating air fan is frequently also incorporated into the back wall, which can also have a separate heating ring in order not only to recirculate air, but also to produce hot air.

Another known approach is to embody oven walls of glass or glass ceramic. The use of glass ceramic in ovens is known from Canadian Patent Reference CA 2,183,498, which discloses an oven composed of glass ceramic for better cleanability. German Patent Reference DE 35 27 957 C2 describes an oven muffle composed of glass ceramic that is detachably assembled and is heated by externally mounted radiant heating elements. The plates are inserted into a supporting or holding frame, which means that the resulting edges and joints, particularly in the lower corner regions of the oven muffle, can only be cleaned with great difficulty. In addition, it has a high degree of structural complexity. Taking this into account, German Patent Reference DE 35 27 958 C2 proposes an enameled sheet steel muffle, with window openings provided in the side walls, into which the glass or glass ceramic plates are inserted. In this case, the same problem arises. In addition to the fact that the joints and connections can only be cleaned with difficulty, a large portion of the muffle chamber is again composed of enameled sheet steel.

SUMMARY OF THE INVENTION

One object of this invention is to provide an oven muffle that is easy to clean and has a low level of structural complexity.

This object is attained because the wall elements are integrally joined to one another and constitute one formed part. According to this invention, the wall elements are oriented at an angle with respect to one another. This yields an easy-to-clean, closed contour in the transition region between the two wall elements, oriented toward the interior. The integral joining of the glass or glass ceramic wall elements produces a mechanical bond that has a sufficient static stability. It is possible to eliminate the use of a support frame in order to simplify the construction.

According to one embodiment of this invention, it is possible for the formed part to have three wall elements and for the wall elements to be arranged so that the formed part is embodied as essentially V-shaped or U-shaped. If the oven muffle is embodied so that the two wall elements embodied as side walls are bent from the wall element embodied as the floor or ceiling, from its sides adjacent to opposing wall elements, then all of the edge regions of the oven muffle in which soiling usually has an elevated tendency to collect are easy to clean.

In one alternative embodiment of this invention, the boundary edges oriented toward the front and/or back of the oven muffle, belonging to the wall elements that have been bent toward each other, transition into each other to form a flat sealing surface. This makes it easy to achieve a successful contact and sealing of the oven door at the front of the oven muffle. An additional wall element that delimits the rear surface of the interior can be placed in a sealed fashion against the back surface of the formed part.

It is also possible for at least one of the wall elements to form a flat sealing surface on its side oriented away from the other formed-on wall element. It is then possible for additional wall elements or also other formed parts to be attached in a simple, sealed fashion to the sides of the wall elements.

The functionality of the formed part can be improved even further if at least one of the wall elements has at least one functional element, such as a projection, a receptacle, and/or a recess, integrally formed into or onto it, which is formed into the inner surface of the wall element oriented toward the interior or which protrudes from the inner surface into the interior.

In this case, it is possible for an oven muffle to be embodied, for example, so that in the region of or near the front and/or rear side of the oven muffle, the functional element is formed into or onto the wall element that constitutes or forms the oven muffle floor and/or the wall elements that constitute or form the oven muffle side walls. The functional element can then be used as a barrier or dam to prevent grease from leaking out.

It is also possible for the functional elements to be in the form of receptacles formed into or onto at least one of the wall elements forming the oven muffle side walls. The functional elements here are then able to perform a supporting function. In one embodiment of the oven muffle, the two wall elements that constitute or form the oven muffle side walls have receptacles that constitute or form guides for baking sheets, extending in the direction of the depth of the oven muffle. The concept of simple cleanability is thus also taken into account.

The functional element can also be a grease-catching basin, in the form of a recess in the oven muffle floor.

According to one embodiment of this invention, it is also possible for the interior to be delimited by at least two formed parts. The formed parts can then be assembled to delimit at least some regions of the interior. This results in a stable construction because the formed parts, in a frame-like fashion, constitute or form the oven muffle floor, the two oven muffle side walls, and the oven muffle ceiling.

Alternatively or in addition, it is possible for the formed part to be attached to at least one plate-like wall element that delimits the interior and for the formed part and the at least one plate-like wall element, in frame-like fashion, to constitute or form the oven muffle floor, the two oven muffle side walls, and the oven muffle ceiling.

The two above-mentioned frame-like structures successfully achieve a stable fixing of the assembly in a simple fashion because the formed parts or the formed part and the plate-like wall element are clamped against each other by strap elements. In order to account for the different thermal expansion behavior of the strap and of the glass/glass ceramic, it is possible for the strap to be embodied as spring-elastic in at least some regions or for the strap to be equipped with a spring element.

If the oven muffle according to this invention is embodied so that a supporting piece is held in the region of or near the joint between two formed parts placed against each other or in the region of or near the joint between a formed part and a plate-like wall element, then the functionality can be increased with a low level of complexity. The supporting piece can then be used either internally or externally for attaching add-on pieces. It is possible for a supporting frame to be fastened on the interior, such as for baking sheets, roasting pans, and the like. On the outside, the supporting piece can be equipped, for example, with mounts for suspending the oven muffle in the range.

It is also possible for the strap element to be equipped with mounting elements. It is then possible, for example, to fasten heating elements to the strap. The mounting elements can also be used for suspending the oven muffle in the range.

The supporting piece can also have a lamp for illuminating the interior. In particular, a temperature-resistant lamp can be in the form of optical fibers that couple their light into the edge of the wall element, in the vicinity of or near the joint.

BRIEF DESCRIPTION OF THE DRAWINGS

This invention is explained in view of exemplary embodiments shown in the drawings, wherein.

DETAILED DESCRIPTION OF THE INVENTION

Figure 1:
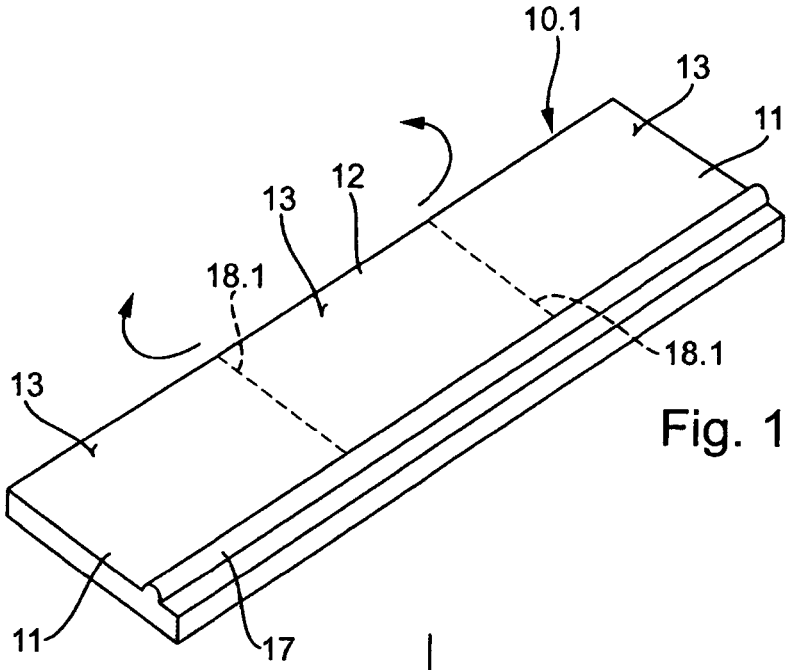
FIG. 1 is a perspective view of a laminar blank composed of a glass or glass ceramic material.

FIG. 1 shows a laminar, rectangular blank 10.1 comprising or composed of glass or glass ceramic cut from a glass/glass ceramic band. The top surface of the blank 10.1 has a continuous projection 17 profiled into it, which is formed from the melt during the rolling of the glass band. In FIG. 1, bending lines 18.1 are indicated with dashed lines, extending in the width direction of the blank 10.1. At these bending lines 18.1, the blank 10.1 is shaped into the formed part 10 shown in FIG. 2. During this, two vertical side wall elements 11 are bent upward from a horizontal wall element 12 at the bending lines 18.1 to form a U-shape, with rounded bending edges 18. The wall elements 11 extend parallel to each other and perpendicular to the wall element 12. It is possible for the wall elements 11 to be set in a V-shape, at an angle of greater than 90° in relation to the wall element 12.

Figure 2:
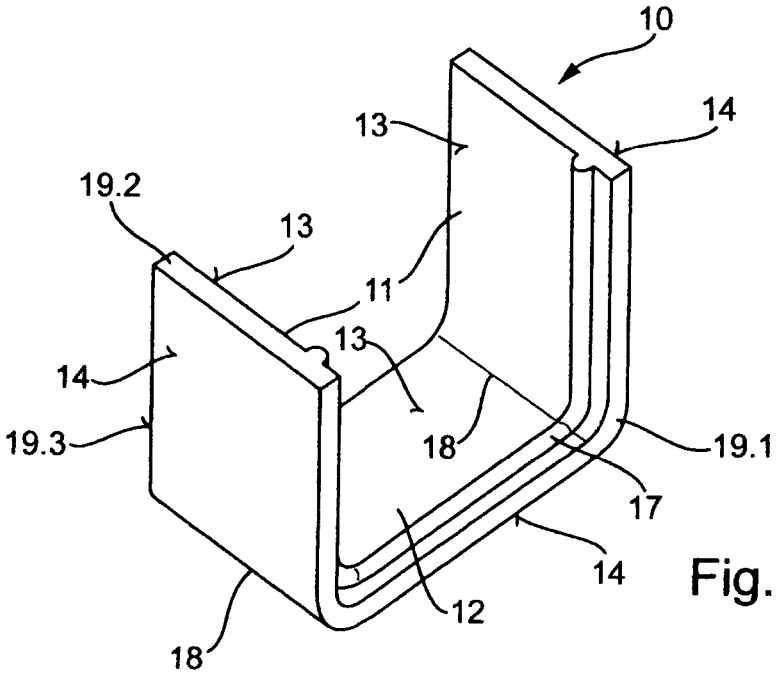
FIG. 2 is a perspective view of a formed part produced from the blank according to FIG. 1.

As shown in FIG. 2, the projection 17 in the region of the front of the oven muffle forms a spill barrier in the oven, the wall element 12, that prevents grease, for example, from leaking out. The inner surfaces 13 of the wall elements 11 and 12 transition into each other in a rounded fashion for a favorable cleanability in the coupling regions. The front and rear edges of the wall elements 11 and 12 transition into each other in a flush fashion, yielding flat sealing surfaces 19.1 and 19.3. An oven door, not shown, and an additional wall element, not shown, can abut it in a sealed fashion from the front and rear, respectively. The free ends of the wall elements 11 form horizontal sealing surfaces 19.2.

Figure 3:
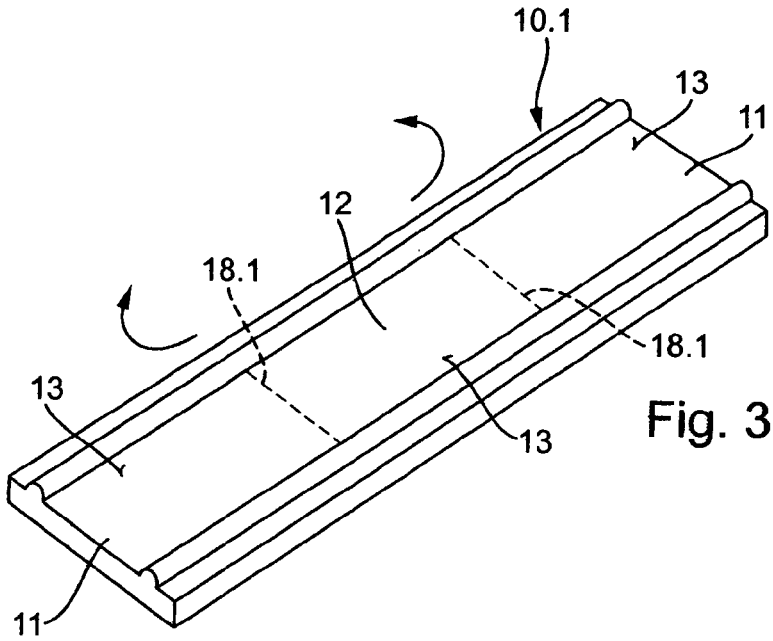
FIG. 3 is a perspective view of a laminar blank composed of a glass or glass ceramic material.
Figure 4:
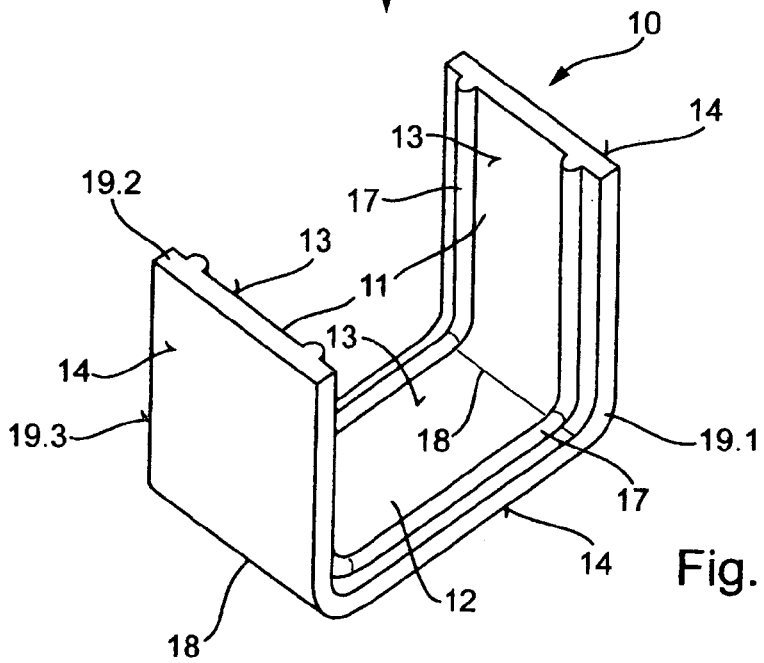
FIG. 4 is a perspective view of a formed part produced from the blank according to FIG. 3.

FIGS. 2 and 3 respectively show a blank 10.1 and a formed part 10 for an oven muffle, whose embodiments correspond to those of the blank 10.1 and the formed part 10 according to FIGS. 1 and 2. The only difference is the embodiment of a second projection 17 situated or positioned in the rear region of or near the oven muffle. Consequently, a spatially delimited catch-basin is formed between the two bottom projections 17 and the respective wall elements 11.

Figure 5:
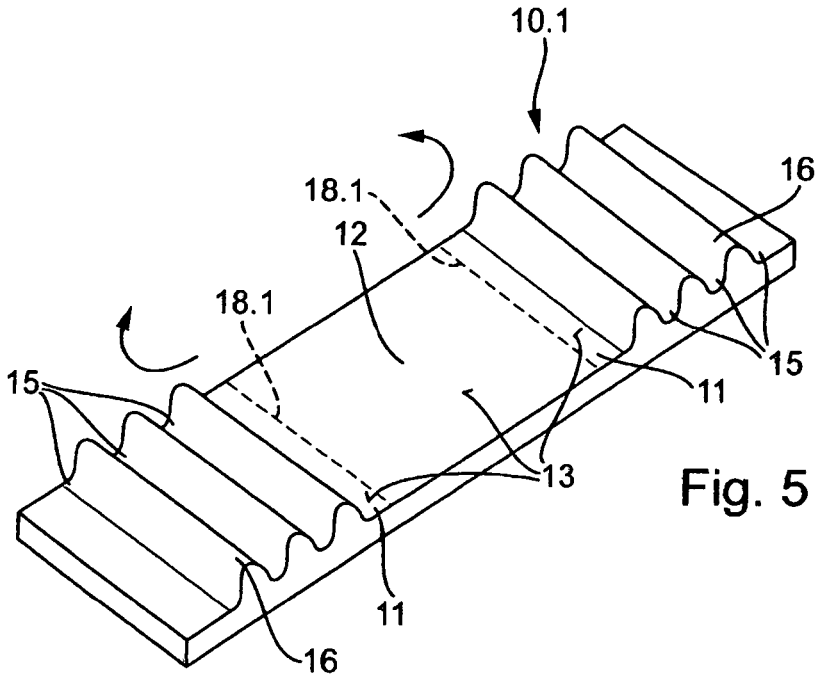
FIG. 5 is a perspective view of a laminar blank composed of a glass or glass ceramic material.
Figure 6:
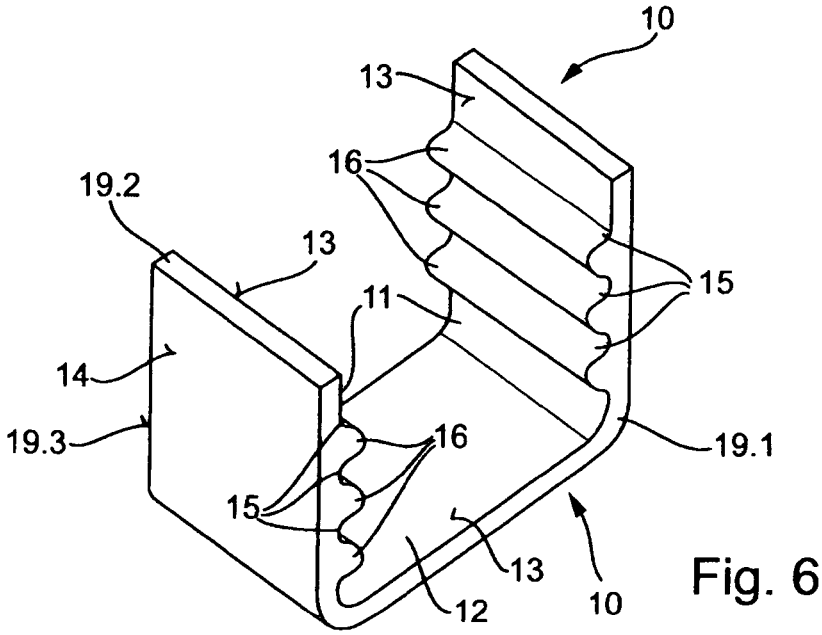
FIG. 6 is a perspective view of a formed part produced from the blank according to FIG. 5.

FIGS. 5 and 6 show embodiments of this invention that essentially correspond to those in FIGS. 1 and 2. As shown in FIG. 5, the inner surface 13 of the blank regions that constitute or form the side wall elements 11 have an undulating profile integrated into them. This forms rail-shaped recesses 15 that extend in the direction of the depth of the oven muffle which corresponds to the width of the blank 10.1. The recesses 15 here are delimited by the projections 16 of the undulating profile elements. The profiling is stamped into the melt during the rolling of the glass band. The recesses 15 of the two wall elements 11 are situated or positioned opposite each other so that baking sheets or guide rails can be slid into them.

Figure 7:
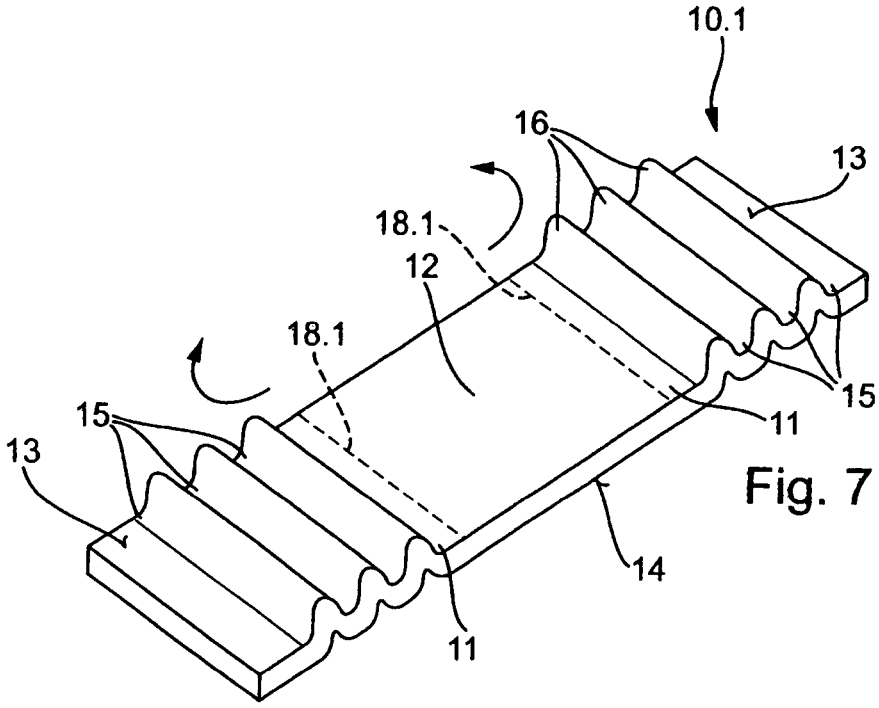
FIG. 7 is a perspective view of a laminar blank composed of a glass or glass ceramic material.
Figure 8:
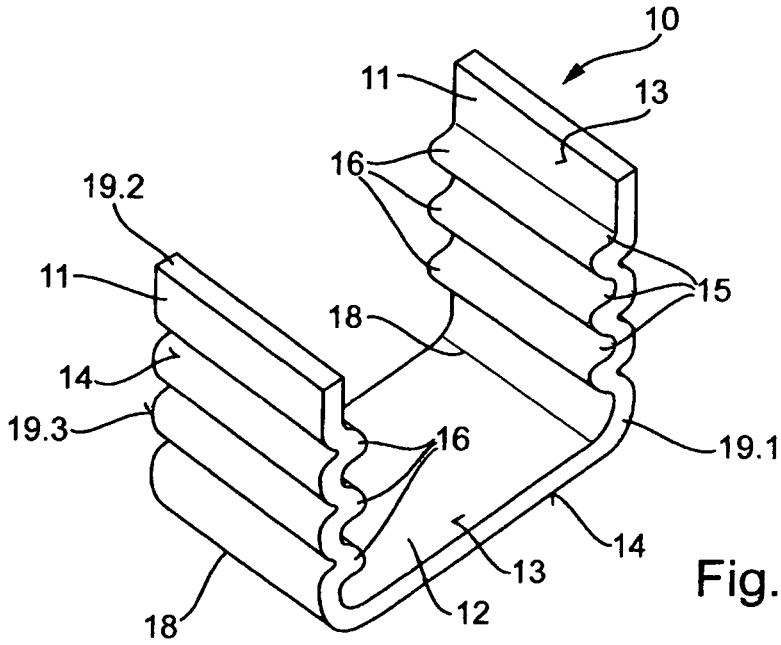
FIG. 8 is a perspective view of a formed part produced from the blank according to FIG. 7.

By contrast with the embodiment according to FIGS. 5 and 6, the undulating profiling can be provided in both the inner surface 13 and the outer surface 14 of the wall elements 11, thus imparting an undulating pattern to the side muffle wall, the wall element 11, as a whole. The function of the resulting internal recesses 15 and projections 16 corresponds to those shown in FIG. 6, but the projections 16 according to FIGS. 7 and 8 can be stamped with greater intensity.

Figure 9:
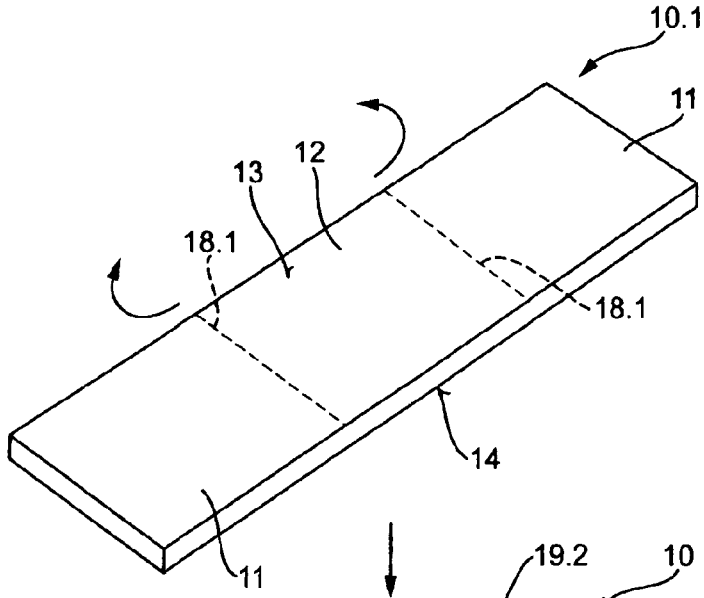
FIG. 9 is a perspective view of a laminar blank composed of a glass or glass ceramic material.
Figure 10:
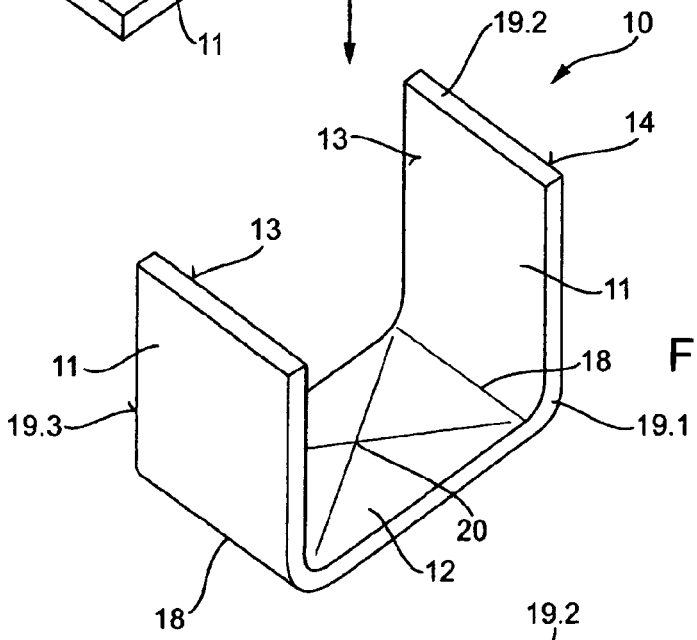
FIG. 10 is a perspective view of a formed part produced from the blank according to FIG. 9.
Figure 11:
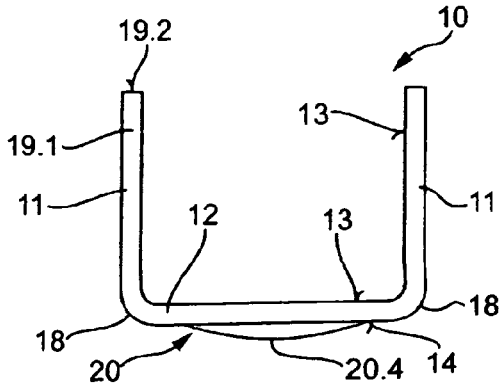
FIG. 11 is a front view of a formed part produced from the blank according to FIG. 9.

FIGS. 9 through 11 show a formed part for an oven muffle in which the wall element 12 constituting the floor has a recess 20 for catching spills. Starting from a flat glass ceramic plate, as shown in FIG. 9, a basin 20.4 in the floor region is produced during the forming process or in a subsequent, separate deforming process. This basin-shaped recess can usually be produced solely by the action of gravity on the glass ceramic plate during reheating.

Figure 12:
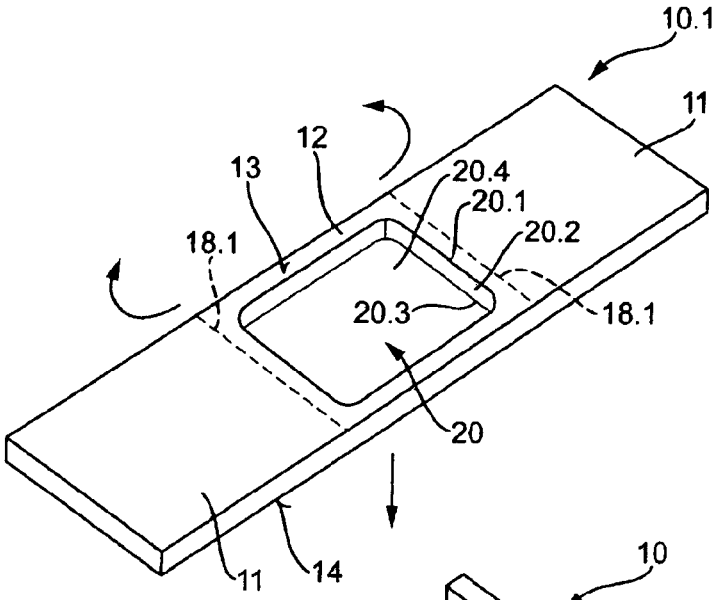
FIG. 12 is a perspective view of a laminar blank composed of a glass or glass ceramic material.
Figure 13:
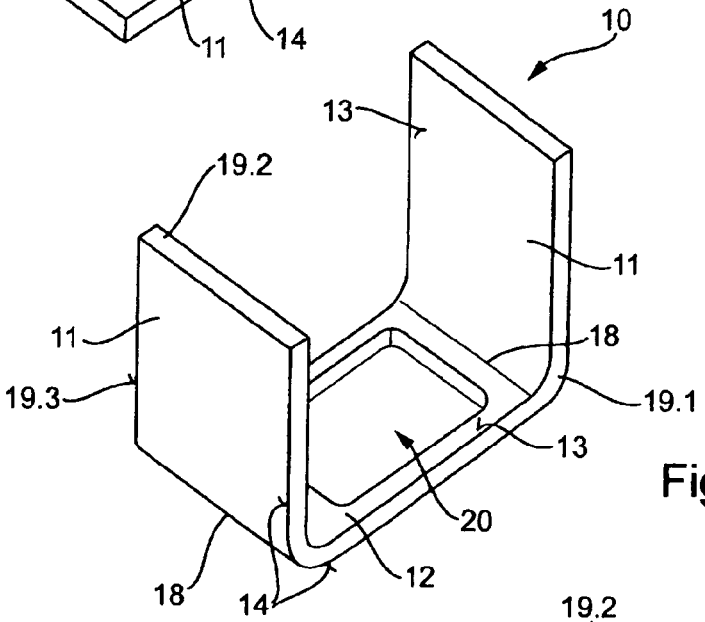
FIG. 13 is a perspective view of a formed part produced from the blank according to FIG. 12.
Figure 14:
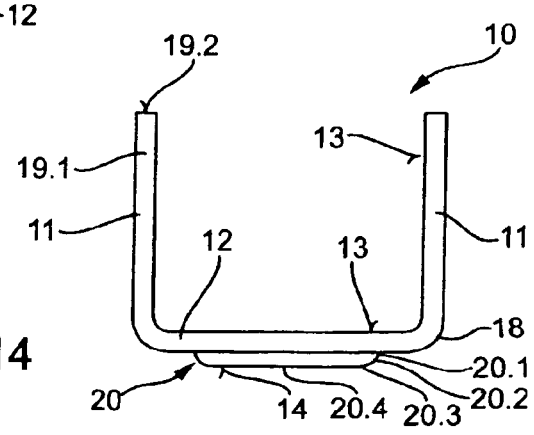
FIG. 14 is a perspective view of a formed part produced from the blank according to FIG. 11.

FIGS. 12 through 14 likewise show the embodiment of a bottom basin for catching spills. In this case, however, the bottom basin 20.4 is produced by a forced deformation of the glass blank, which is moved downward by pressure or vacuum. The advantage here is that it is possible to produce forms, the bending edges 20.1, 20.2, and 20.3, that are larger and more sharply stamped than in the manufacturing procedure demonstrated in FIGS. 10 and 11.

Figure 15:
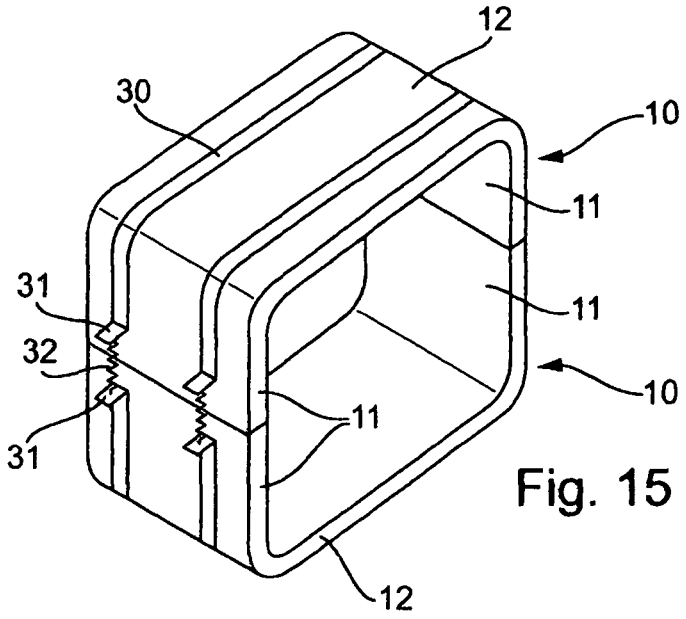
FIG. 15 is a perspective view of an oven muffle component including two structurally identical U-shaped formed parts.

FIG. 15 shows a component for an oven muffle that comprises or is composed of two U-shaped formed parts 10 that are produced and embodied in accordance with FIG. 2, except for the projection 17. The two formed parts 10 are structurally identical, thus requiring only one production die. The two formed parts 10 are placed against each other in the region of or near the sealing surfaces 19.2, with the interposition of a Teflon™ or graphite strip serving as a sealing element 19.4. This produces a circumferential frame in which the lateral wall elements 11 of the two formed parts 10 respectively constitute or form the oven muffle side walls and the wall elements 12 respectively constitute or form the oven muffle ceiling and oven muffle floor.

The frame-like component is held together by two strap elements 30 that are embodied in the form of clamping straps. The strap element 30 is embodied as a metal band that has angled pieces 31 pointing outward at its band ends. Tabs 31.1 are punched and bent out from the angled pieces 31. The tabs 31.1 each have an opening 31.2. The strap elements 30 are looped around the front and back regions of the frame and the band ends are aligned with each other. A Teflon™ or graphite strip provided to protect against scratching can be inserted between the strap element 30 and the formed parts 10.

Figure 16:
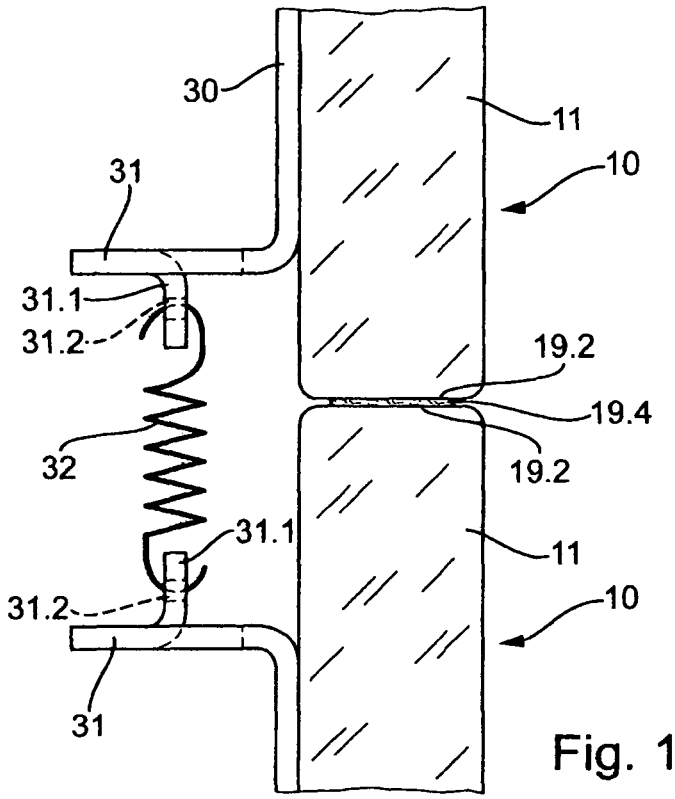
FIG. 16 is a detail view taken from FIG. 15.

When attaching glass ceramic muffles to metal parts, it is inherently necessary to take into account the different thermal expansions of the two materials because the metal frame expands or, if the metal frame were to internally engage in the oven muffle or were to be affixed to the oven muffle, the glass ceramic muffle would then crack and break during heating. For this reason, the band ends of the strap element 30 are attached to a spring element 32. The spring ends are suspended in a prestressed fashion in the openings 31.2 of the angled pieces 31. This takes into account the different thermal expansion behaviors. The spring element 32 can also be situated or positioned in a location other than the one shown in FIG. 16. It is also possible for the two formed parts 10 to be integrally joined to each other, for example by soldering or welding.

Figure 17:
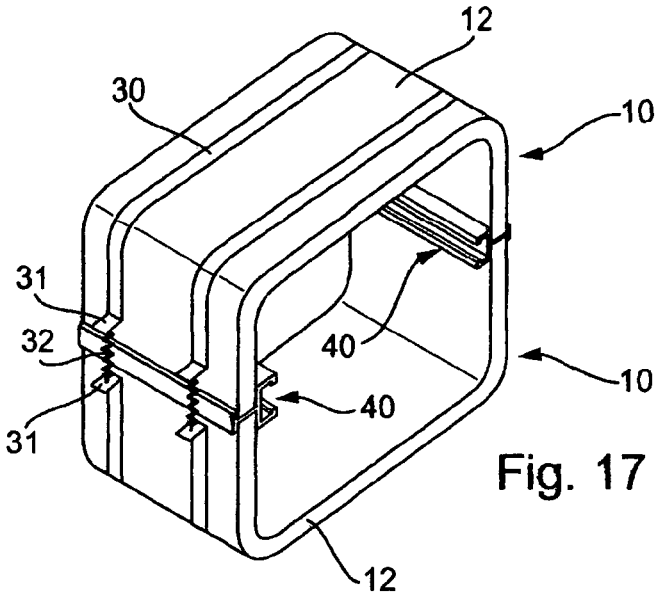
FIG. 17 is a perspective view of an oven muffle component including two structurally identical U-shaped formed parts.
Figure 18:
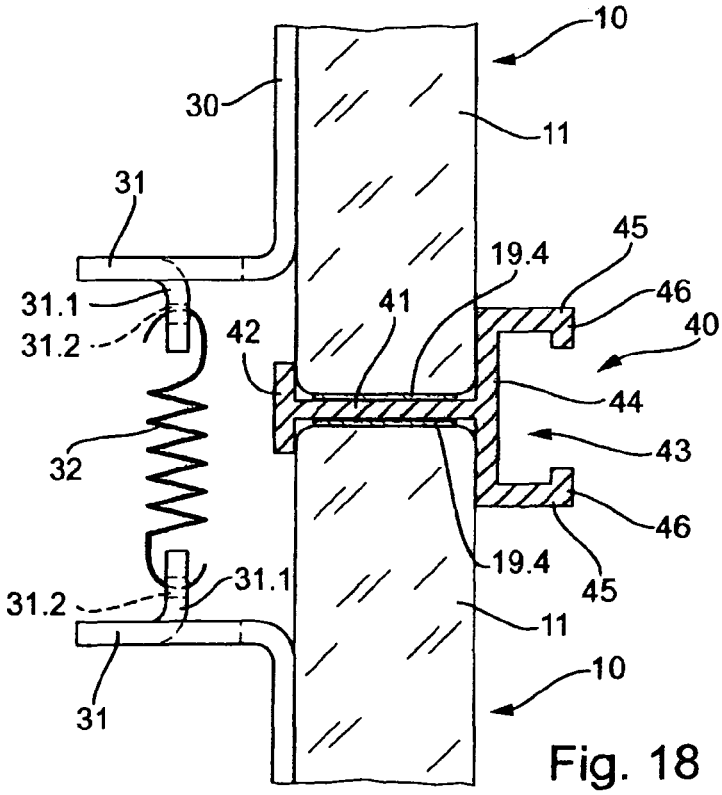
FIG. 18 is a detail view taken from FIG. 17.

The arrangement shown in FIGS. 17 and 18 corresponds to the one shown in FIGS. 14 and 15, with supporting pieces 40 embodied in the form of profiled sections inserted in the region of or near the joints of the formed parts 10. The supporting pieces 40 have a bridge piece 40, which supports a widened shoulder 42. On the inside, the bridge piece 40 has a holding section 44 formed onto it, which has two legs 45. The legs 45 are spaced apart from and parallel to each other. End sections 46 protrude at right angles from the leg ends 45, providing an undercut receptacle 43 extending in the depth direction. In this receptacle 43, fastening means, such as racks, baking sheets, rollers, guide rails, and the like, can be held and affixed in the interior of the oven muffle. The shoulder 42 and the holding section 44 prevent the supporting piece 40 from being pulled out from the joint. Sealing elements 19.4 are inserted between the bridge piece 41 and each of the sealing surfaces 19.2.

Figure 19:
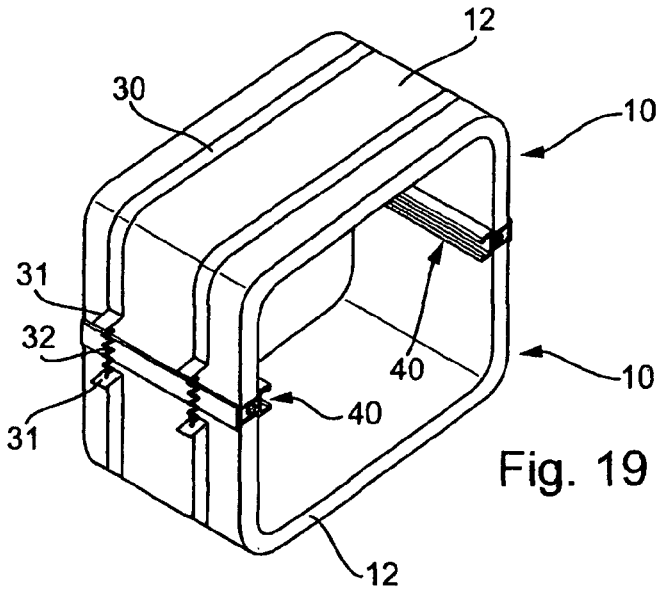
FIG. 19 is a perspective view of an oven muffle component including two structurally identical U-shaped formed parts.
Figure 20:
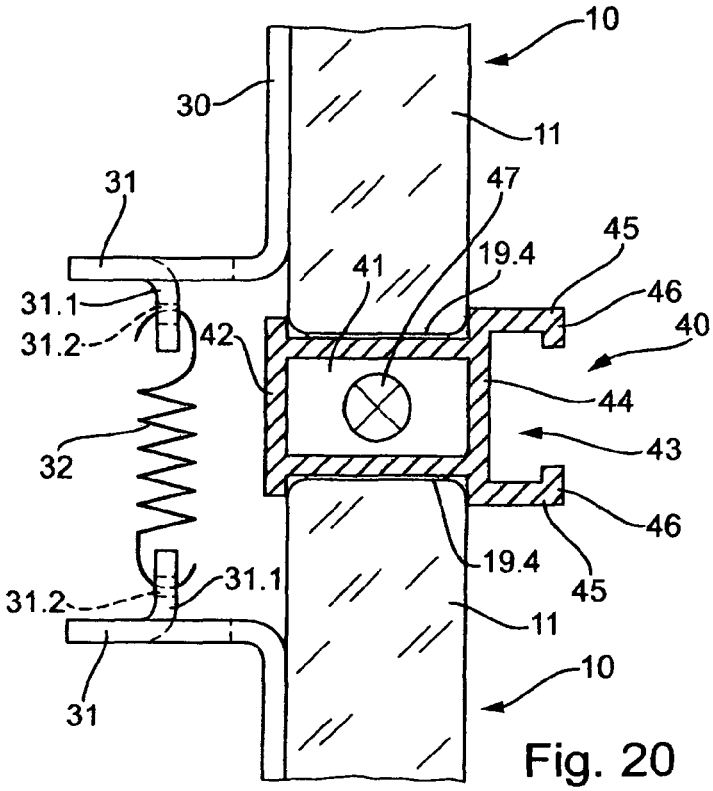
FIG. 20 is a detail view taken from FIG. 19.
Figure 21:
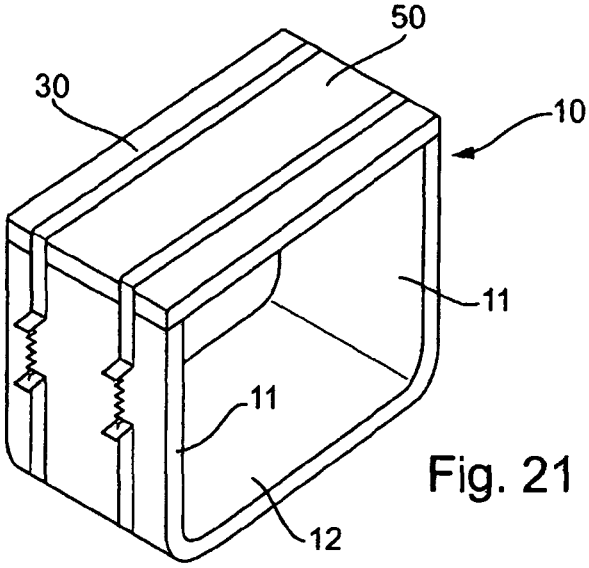
FIG. 21 is a perspective detail view of an oven muffle component including a U-shaped formed part and a plate-shaped wall element.
Figure 22:
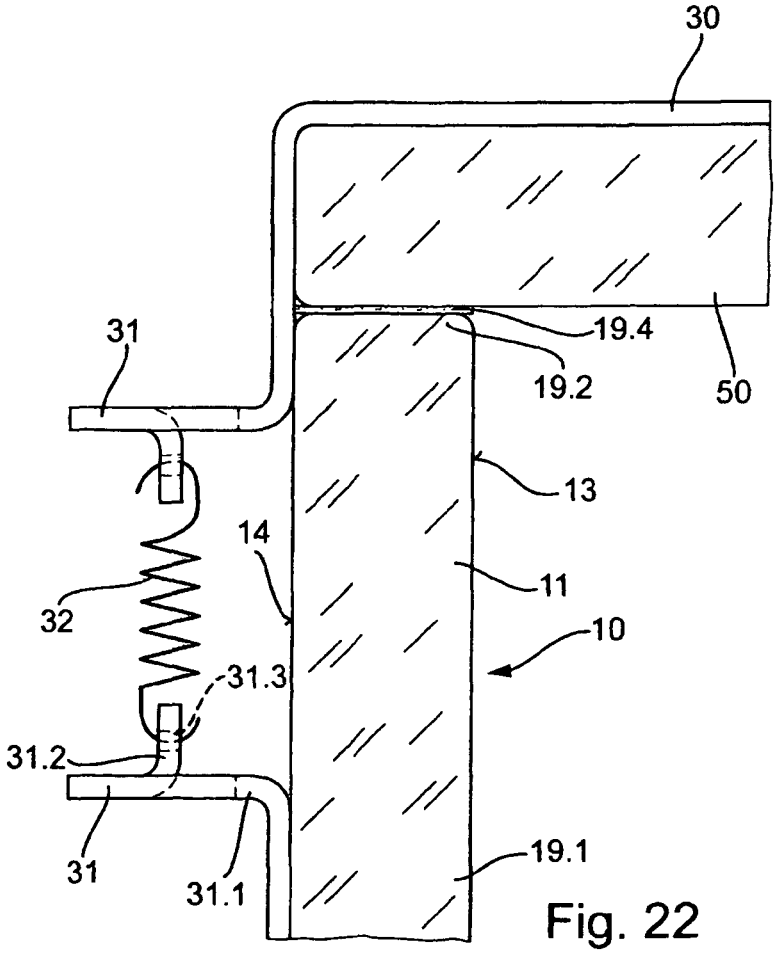
FIG. 22 is a detail view taken from FIG. 21.

The embodiment shown in FIGS. 19 and 20 differs from the one according to FIGS. 17 and 18 in that the bridge piece 41 of the supporting piece 40 is embodied in the form of a hollow profile and accommodates lamps 47 embodied in the form of an LED chain for illuminating the cooking chamber. It is possible to embody a supporting piece 40 that does not have a receptacle 43 and only accommodates the lamps 47.

In addition to the shell-shaped formed parts 10 shown in FIGS. 15 through 20, it is also possible for the side wall elements 11 of the U-shaped profile to be embodied as taller and for an essentially flat wall element 50 in the form of a glass ceramic plate to be placed onto it as a muffle ceiling. The connection and fastening are carried out in a fashion analogous to the options described in conjunction with FIGS. 15 through 20.

Figure 23:
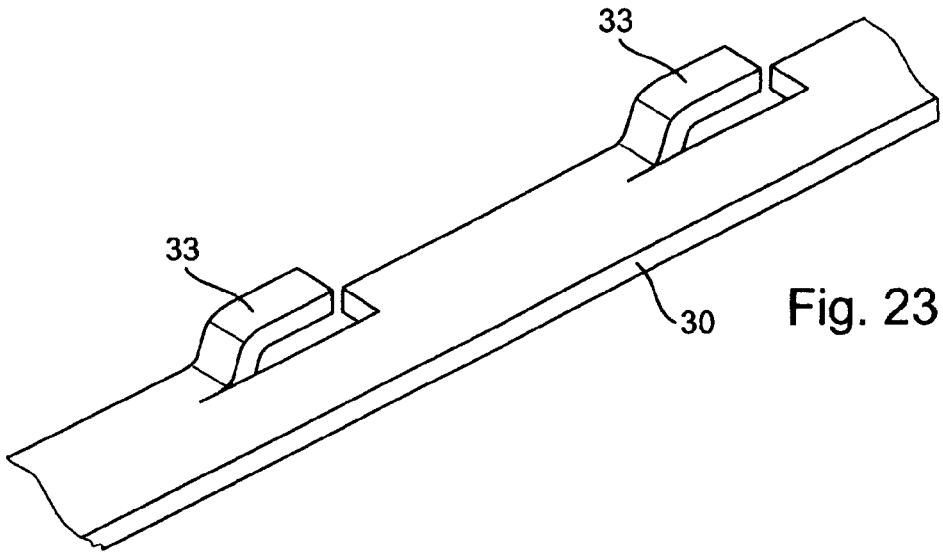
FIG. 23 is a perspective view of a section of a strap element.

In order to secure the oven muffle inside the oven unit as a whole, this invention provides the strap element 30 with punched-out tabs 33, as shown in FIG. 23. The punched-out tabs 33 can be flexibly connected to a range frame 60 by crimping, screwing, riveting, or welding. A sealing element 34 in the form of a peripheral woven tube can be clipped into the intermediate space between the range frame and the oven muffle. This is a known technique that is currently used in pyrolysis ovens. This type of connection takes into account the different expansion of glass ceramic and metal and assures that thermal expansion does not cause the oven muffle to break.

Figure 24:
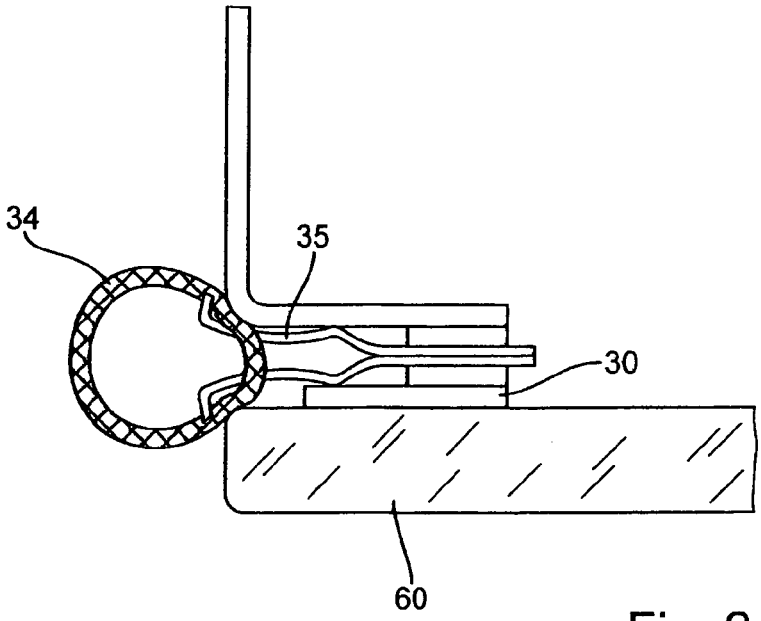
FIG. 24 shows a front view detail of an oven muffle viewed.

The sealing element 34 is secured by a clamp 35. The clamp 35 is situated or positioned between the strap element 30 and the range frame 60, as shown in FIG. 24.

What is claimed is:

1. An oven muffle comprising:

at least two wall elements (11, 12, 50) adjoining each other and delimit at least some regions of an interior space used as a cooking chamber, in which the wall elements (11, 12, 50) are of a glass or a glass ceramic and the adjacent wall elements (11, 12, 50) are oriented at an angle with respect to one another, and the wall elements (11, 12, 50) joined to one another and forming at least one formed part (10), wherein the interior is delimited by at least two formed parts, and the at least two formed parts frame an oven muffle floor, two oven muffle side walls, and an oven muffle ceiling, in a shape of a front and rear open frame; and a supporting piece (40) disposed in a joint between the two formed parts placed against each other, the supporting piece (40) including a fastening receptacle (43) oriented toward the interior, and the supporting piece (40) including two spaced apart and parallel legs (45) defining the receptacle (43).

2. The oven muffle as recited in claim 1, wherein the formed part (10) has three of the wall elements (11, 12) arranged so that the formed part is essentially U-shaped.

3. The oven muffle as recited in claim 2, wherein the two wall elements (11) are bent from a wall element (12) embodied as the oven muffle floor or the oven muffle ceiling, from sides adjacent to opposing wall elements at a bending edge (18).

4. The oven muffle as recited in claim 3, wherein boundary edges oriented toward a front and/or a back of the oven muffle, belonging to the wall elements (11, 12) are bent toward each other and transition into each other to form a flat sealing surface.

5. The oven muffle as recited in claim 4, wherein at least one of the wall elements (11, 12) forms a second flat sealing surface (19.2) on a side oriented away from the other formed-on wall element (11, 12).

6. An oven muffle comprising an interior space used as a cooking chamber and delimited in part by two formed parts (10), each of the two formed parts including three wall elements (11, 12, 50) adjoining each other and delimiting a portion of the interior space, each of the three wall elements (11, 12, 50) are of a glass or a glass ceramic, adjacent wall elements (11, 12, 50) are oriented at an angle with respect to one another, the three wall elements (11, 12, 50) are integrally joined to one another, and two of the three wall elements include a horizontal sealing surface at a free end, wherein the two formed parts (10) combine with each horizontal sealing surface of one of the two formed parts adjacent and facing one of the horizontal sealing surface of an other of the two formed parts to frame an oven muffle floor, two oven muffle side walls, and an oven muffle ceiling, wherein the two formed parts are held together by at least one strap element (30) extending around each of the three wall elements of at least one of the two formed parts, and a supporting piece (40) is disposed between the each horizontal sealing surface and the one of the horizontal sealing surface of the other of the two formed parts, the supporting piece (40) including at least one fastening receptacle (43) extending into the interior space.

7. The oven muffle as recited in claim 6, wherein ends of the at least one strap element (30) are connected by a spring element.

8. The oven muffle as recited in claim 6, wherein the at least one strap element (30) is spring-elastic in at least some regions or has a spring element (32).

9. The oven muffle as recited in claim 6, wherein the formed part (10) has three of the wall elements (11, 12) arranged so that the formed part is essentially V-shaped or U-shaped.

10. The oven muffle as recited in claim 6, wherein two wall elements (11) are bent from a wall element (12) embodied as the oven muffle floor or the oven muffle ceiling, from sides adjacent to opposing wall elements at a bending edge (18).

11. The oven muffle as recited in claim 6, wherein boundary edges oriented toward a front and/or a back of the oven muffle, belonging to side wall elements (11, 12) are bent toward each other and transition into each other to form a flat sealing surface.

12. The oven muffle as recited in claim 6, wherein the horizontal sealing surface (19.2) forms an end surface of the wall element (11, 12) opposite a bending edge connected to a third of the wall elements.

13. The oven muffle as recited in claim 6, wherein at least one of the wall elements (11, 12) has at least one functional element integrally formed into or onto which is formed into the inner surface (13) of the at least one wall element (11, 12) oriented toward the interior or protrudes from the inner surface (13) into the interior.

14. The oven muffle as recited in claim 13, wherein at the front or rear side of the oven muffle, the functional element (17) is formed into or onto the wall element (11, 12) that forms the oven muffle floor and/or the wall elements (11, 12) that form the oven muffle side walls.

15. The oven muffle as recited in claim 13, wherein the at least one functional element is a receptacle (15) formed into or onto at least one of the wall elements (11, 12) forming the oven muffle side walls.

16. The oven muffle as recited in claim 6, wherein the two wall elements (11) that form the two oven muffle side walls have receptacles (15) that form guides for baking sheets, extending in a direction of a depth of the oven muffle.

17. The oven muffle as recited in claim 6, wherein the supporting piece has at least one lamp (47).

18. The oven muffle as recited in claim 6, wherein the strap element (30) has securing elements (33).

19. The oven muffle as recited in claim 6, wherein the strap element (30) supports a sealing element (34).

20. The oven muffle as recited in claim 6, wherein the supporting piece (40) comprises a bridge piece disposed between the two formed parts, a widened shoulder disposed outside the interior space and at an end of the bridge piece that is opposite the receptacle (43), and two spaced apart and parallel legs (45) defining the receptacle (43).

21. An oven muffle comprising:

a first formed part and a second formed part, each of the first formed part and the second formed part formed of a glass or a glass ceramic and including two vertical wall elements integrally joined to a horizontal wall element, wherein each of the two vertical wall elements include a free end terminating at a sealing surface that is disposed parallel to the horizontal wall element;

the first formed part and the second formed part joined to form an interior space cooking chamber, wherein the sealing surface of one of the vertical wall elements of the first formed part is placed against a corresponding sealing surface of one of the vertical wall elements of the second formed part, and the sealing surface of an other of the vertical wall elements of the first formed part is placed against a corresponding sealing surface of an other of the vertical wall elements of the second formed part;

a sealing element disposed between adjacent sealing surfaces; and a supporting piece (40) including a portion disposed between adjacent sealing surfaces, and the supporting piece (40) including a fastening receptacle (43) disposed within the interior space cooking chamber;

wherein the first formed part and the second formed part frame an oven muffle floor, two oven muffle side walls, and an oven muffle ceiling.

22. The oven muffle as recited in claim 21, further comprising two strap elements, each of the strap elements extending around the two vertical wall elements and the horizontal wall element of one of the first formed part and the second formed part.

23. The oven muffle as recited in claim 22, wherein each of the strap elements is spring-elastic in at least some regions or comprises a spring element.

24. The oven muffle as recited in claim 22, further comprising a spring element connecting ends of each of the two strap elements.

25. The oven muffle as recited in claim 21, further comprising:

two strap elements holding the first formed part joined to the second formed part; and a spring element connecting ends of each of the two strap elements.

26. The oven muffle as recited in claim 25, wherein the ends of the strap elements include angled sections extending outward from the first formed part or the second formed part, and the spring element connects to and between two adjacent angled sections.

27. The oven muffle as recited in claim 26, wherein the angled sections each include a punched and bent tab with an opening receiving one end of the spring element.

28. The oven muffle as recited in claim 21, wherein the first formed part and the second formed part are each essentially V-shaped or U-shaped.

29. The oven muffle as recited in claim 21, wherein the two vertical wall elements are side walls bent from the horizontal wall element that is embodied as the oven muffle floor or the oven muffle ceiling, from sides adjacent to opposing wall elements at a bending edge.

30. The oven muffle as recited in claim 21, wherein the each horizontal sealing surface forms an end surface of the vertical wall element opposite a bending edge connected to the horizontal wall element.

31. The oven muffle as recited in claim 21, wherein at least one of the vertical wall elements has at least one functional element which is integrally formed into an inner surface of the at least one vertical wall element or protrudes from the inner surface into the interior space.

32. The oven muffle as recited in claim 31, wherein the at least one functional element is a receptacle formed into or onto at least one of the vertical wall elements forming the oven muffle side walls.

33. An oven muffle comprising:

at least two wall elements (11, 12, 50) adjoining each other and delimit at least some regions of an interior space used as a cooking chamber, in which the wall elements (11, 12, 50) are of a glass or a glass ceramic and the adjacent wall elements (11, 12, 50) are oriented at an angle with respect to one another, and the wall elements (11, 12, 50) joined to one another and forming at least one formed part (10), wherein the interior is delimited by at least two formed parts, and the at least two formed parts frame an oven muffle floor, two oven muffle side walls, and an oven muffle ceiling, in a shape of a front and rear open frame; and a supporting piece (40) disposed in a joint between the two formed parts placed against each other, the supporting piece (40) including a fastening receptacle (43) oriented toward the interior, wherein the supporting piece (40) comprises a bridge piece disposed between the two formed parts, and a widened shoulder disposed at an end of the bridge piece that is opposite the receptacle (43).

34. The oven muffle as recited in claim 33, wherein the supporting piece (40) comprises two spaced apart and parallel legs (45) defining the receptacle (43).

* * * * *